US005860654A

United States Patent [19]

Jacobs

[11] Patent Number: 5,860,654

[45] Date of Patent: Jan. 19, 1999

[54] PORTABLE TARGET ASSEMBLY

[76] Inventor: Bruce P. Jacobs, 1322 Patterson, Muskogee, Okla. 74403

[21] Appl. No.: 964,195

[22] Filed: Nov. 10, 1997

[51] Int. Cl.[6] ..... F41J 1/00

[52] U.S. Cl. ..... 273/407

[58] Field of Search ..... 273/407, 408; 473/190, 197

[56] References Cited

U.S. PATENT DOCUMENTS

| | | | |
|---|---|---|---|
| 225,734 | 3/1880 | Tangeman | 273/404 |
| 2,890,051 | 6/1959 | Williams | 273/407 |
| 3,080,166 | 3/1963 | Clark | 273/407 |
| 3,601,353 | 8/1971 | Dale | 248/470 |
| 4,029,318 | 6/1977 | Boss | 273/102 |
| 4,726,593 | 2/1988 | Wade | 273/392 |
| 5,678,824 | 10/1997 | Fortier et al. | 273/407 |

*Primary Examiner*—William H. Grieb
*Attorney, Agent, or Firm*—Robert K. Rhea

[57] ABSTRACT

An upright open frame formed by an inverted U-shape member having rigidly interconnected legs entering the earth to support the frame in an upright position. A target anchor bar having sufficient mass to normally hold a target taut within the frame is slidably supported by the legs. Fastener members connected with the bight of the U-shaped frame and the anchor bar are connected with respective end portions of a target to be supported within the frame.

4 Claims, 1 Drawing Sheet

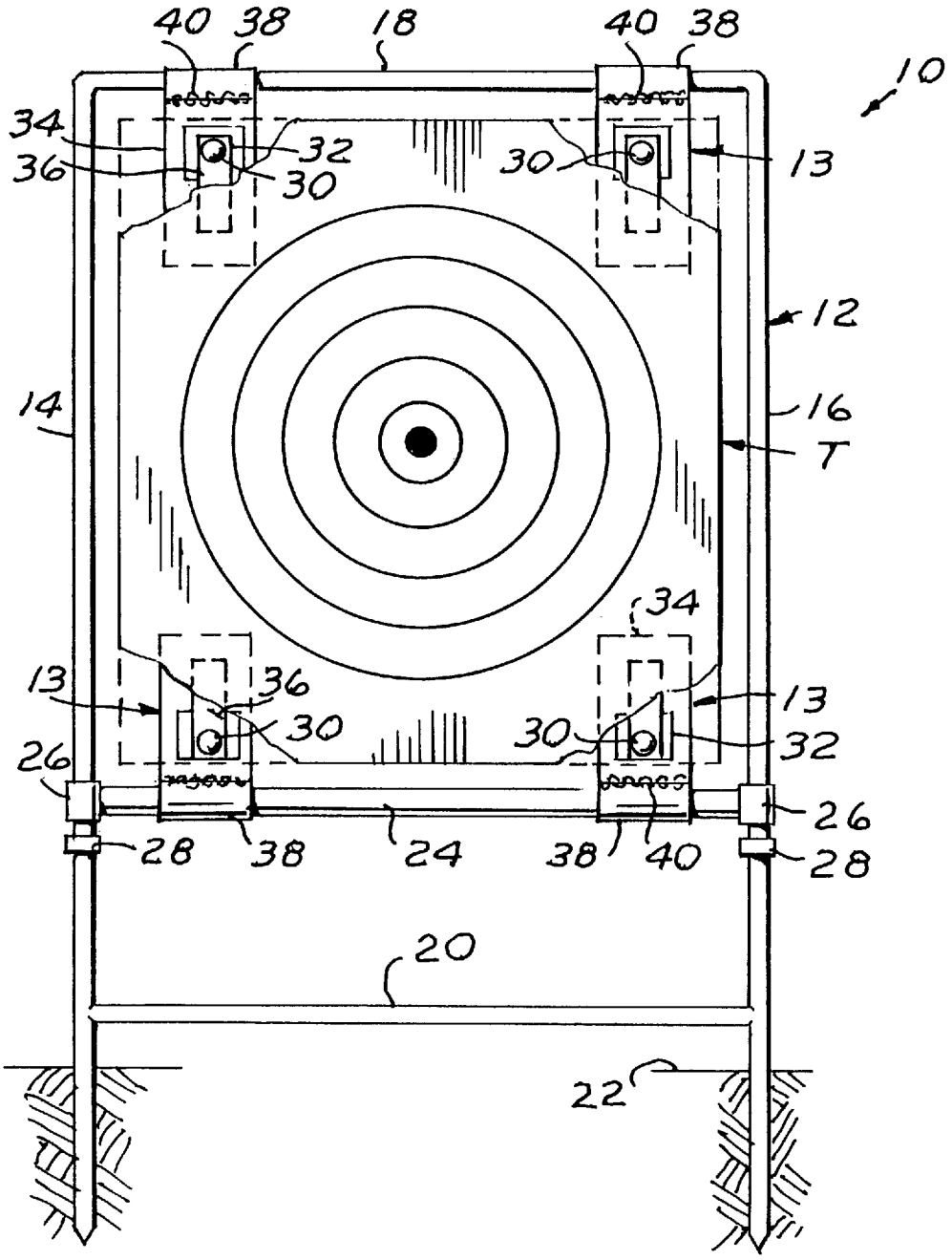
40
38
18
40
38
10
34
32
36
30
30
13
12
14
16
T
34
13
36
30
30
32
13
26
26
28
38
24
38
40
28
20
22

PORTABLE TARGET ASSEMBLY

BACKGROUND OF THE INVENTION

This invention relates to target practice and more particularly to an improved target support to be used preferably by shooters in practicing small caliber target practice.

1. Field of the Invention

Small caliber targets are usually formed from sheet material, for example, a sheet of paper or cardboard which may vary in size and is usually rectangular in overall configuration.

Paper targets, usually rectangular, need to be supported, particularly at their top and bottom end portions, to maintain them in a generally vertical plane to prevent wind currents moving the targets. Further, when changing targets during target practice, it is desirable that the old target be easily removed and the new one installed without manually changing clamps and making other adjustments for the fresh target in the event the targets are not of the same size. This invention provides a target holder which will accommodate substantially any size target presently in use.

2. Description of the Prior Art

U.S. Pat. No. 3,601,353 issued Aug. 24, 1971 to Dale for Adjustable Target Holder discloses a target holder having a crossbar connecting pair of legs which may be inserted into the ground for support. One of the legs is extended upwardly and supports a lateral bar parallel with the crossbar of the legs, and receives clips which support a target in the vertical spacing between the lateral bar and crossbar.

U.S. Pat. No. 4,029,318 issued Jun. 14, 1977 to Boss for Portable, Adjustable Target Stand, and U.S. Pat. No. 4,726,593 issued Feb. 23, 1988 to Wade for Portable Target Assembly are believed good examples of the further state-of-the-art.

The Boss patent discloses a base formed by inverted U-shaped pivotally connected scissor legs which support an upright U-shaped target holder pivoted to the base and maintained in a generally upright position by an elongated brace rod adjustable connected with the other of the scissor connected base legs. Cross rods between the upright target holder are frictionally engaged with a respective leg of the target holder which must be vertically adjusted to the vertical length of the target to engage clips therewith supported by the cross rods.

The Wade patent discloses upright laterally spaced-apart posts on a rigid base which supports a sheet target therebetween. A cross rod between the posts supports a swinging target in depending relation. This target holder, like many others, requires adjustment of the components when replacing targets, but has the added feature that it may be completely disassembled and stored in the base.

This invention is believed distinctive over the above named and other patents by providing a rigid target holder having legs easily entering the surface of the earth for supporting the target holder in an upright one piece manner, with the exception of a horizontal crossbar, gravity moved downward by its sleeve ends surrounding the upright legs.

BRIEF SUMMARY OF THE INVENTION

An upright open frame formed by an inverted U-shaped member having legs rigidly interconnected by a brace bar adjacent their ends opposite the bight portion which limit movement of the legs into the surface of the earth. A vertically moveable target anchor bar is provided with sleeves at its respective ends which slidably surround the U-shaped frame legs. A plurality (4) of snap fasteners and tabs are respectively secured to tubes, loosely surrounding the gravity actuated anchor bar and bight portion of the frame, and vertically support a target when disposed within the frame.

The principal object of this invention is to provide a substantially unitary frame for tautly supporting targets of various sizes within the frame by simply attaching the respective target end portions to the upper and lower fasteners of the frame.

BRIEF DESCRIPTION OF THE SEVERAL VIEWS OF THE DRAWINGS

The single FIGURE is an elevational view of the target holder supporting a target.

DESCRIPTION OF THE PREFERRED EMBODIMENTS

The reference numeral 10 indicates the target assembly as a whole formed by an open upright generally rectangular frame 12 supporting a target T within the boundaries of the frame by a plurality (4) fastener means 13. The frame 12 is principally formed from rigid rod-like material or piping and its inverted U-shape is defined by laterally spaced apart upright legs 14 and 16 joined by a bight portion 18. The spacing between the legs 14 and 16 is selected in accordance with the greatest width of a target T to be supported within the frame. A brace member 20 extends between and is rigidly connected with the legs 14 and 16 adjacent their end portions opposite the bight portion 18.

In addition to being a brace, the member 20 also forms a means for forcing (as by foot force) the free ends of the legs 14 and 16 into the surface of the earth, indicated at 22, to maintain the frame 12 in an upright position. A target anchor bar 24 of selected mass extends transversely between the legs 14 and 16, and is provided at its respective ends with sleeves, such as a collar 26, which loosely surrounds the respective leg and permits the bar to be manually raised and gravity lowered to maintain the target T in the vertical plane of the frame as hereinafter explained. Downward movement of the anchor bar 24 is limited by a pair of stops 28 formed with or secured to the perimeter of the legs in equal spaced relation with respect to the position of the brace 20.

A pair of the fastener means 13 is mounted on the bight portion 18 and anchor bar 24 prior to assembling the frame 12. Each of the fastener means preferably comprises cooperating male and female snap fasteners 30 with one member of the snap fastener mounted on a tab 32, in turn secured, as by a screw, not shown, to a generally rectangular rigid support section such as a metallic plate 34. The other member of the snap fastener is mounted on a flap 36 for easily separating the snap fasteners in removing or securing a target. Each fastener mounting member 34 is secured, as by welding 40, to a tube 38, substantially equal in length with the width of the plate 34, and loosely surrounding the bight portion 18 and the anchor bar 24, respectively. The tubes 38 are easily moved manually in either direction along the length of the bight member 18 or anchor bar 24 for adjusting the spacing between the fastener means 13 for securing the target T.

OPERATION

In operation, assuming the frame 12 has been assembled with the fastening means 13 and supported by the end portion of the legs 14 and 16 penetrating the earth 22. The target T is initially positioned within the opening of the frame 12 by separating the snap fasteners 30 at the uppermost pair of fastener means as viewed in the drawing, and positioning apertures in the target in position to rejoin the respective pair of snap fasteners in the upper pair of fasteners 13. The depending end of the target is similarly joined to the lower-most pair of the fastener means while manually supporting the anchor bar 24. Thereafter, the mass of the bar 24 is sufficient to hold the depending end portion of the target substantially within the plane of the frame 12 during target practice.

Obviously the invention is susceptible to changes or alterations without defeating its practicability. Therefore, I do not wish to be confined to the preferred embodiment shown in the drawing and described herein.

I claim:

1. A target assembly, comprising:

an inverted U-shaped rectangular open frame having legs extending in parallel relation from a bight portion in a vertical plane and adapted to be forced into the surface of the earth and having a brace extending between and rigidly connected with the legs adjacent the surface of the earth;

a target anchor bar having a predetermined mass horizontally interposed between said legs above said brace and having a sleeve at its respective end loosely surrounding and slidable along the respective said leg; and, snap fastening means adjustably secured to and along said bight portion and said anchor bar respectively for supporting a target within the plane of said frame, whereby the mass of said anchor bar is sufficient to normally maintain material forming a target taut.

2. The target assembly according to claim 1 in which the fastening means includes:

a tube securing the respective snap fastener means to said bight portion and said anchor bar, respectively.

3. The target assembly according to claim 2 and further including:

a stop on each said leg interposed between said anchor bar and said frame brace.

4. The target assembly according to claim 1 and further including:

a stop on each said leg interposed between said anchor bar and said frame brace.

* * * * *